US005850773A

United States Patent [19]

Burns

[11] Patent Number: 5,850,773

[45] Date of Patent: Dec. 22, 1998

[54] APPARATUS FOR CUTTING WIRE

[75] Inventor: Irvin Burns, Walloon Lake, Mich.

[73] Assignee: Rockford Manufacturing Group, Roscoe, Ill.

[21] Appl. No.: 627,935

[22] Filed: Mar. 28, 1996

[51] Int. Cl.[6] ..... B21F 11/00; B26D 1/553; B26D 5/16

[52] U.S. Cl. ..... 83/159; 83/628; 83/214; 83/950; 225/96.5; 140/140

[58] Field of Search ..... 140/140; 225/95, 225/96, 96.5; 83/949, 950, 159, 628, 598, 599, 602, 604, 80, 213, 471.1, 491, 597, 630, 214

[56] References Cited

U.S. PATENT DOCUMENTS

| | | | |
|---|---|---|---|
| 1,637,824 | 8/1927 | Hidzick | 72/129 |
| 1,975,155 | 10/1934 | Keller | 225/96 |
| 2,101,860 | 12/1937 | Lewis et al. | 140/140 X |
| 2,213,650 | 9/1940 | Grimshaw | 140/140 X |
| 3,442,168 | 5/1969 | Gatto | 83/354 |
| 3,515,021 | 6/1970 | Walus et al. | 83/80 |
| 4,020,880 | 5/1977 | Heller et al. | 140/140 X |
| 4,219,052 | 8/1980 | Aronhalt | 140/140 X |
| 4,621,754 | 11/1986 | Long et al. | 225/96 |
| 4,674,666 | 6/1987 | Balyasny | 225/96 X |
| 4,724,733 | 2/1988 | Suarez et al. | 83/159 |
| 5,570,728 | 11/1996 | Benedict et al. | 140/140 X |

FOREIGN PATENT DOCUMENTS

| | | | |
|---|---|---|---|
| 645383 | 5/1937 | Germany | 140/140 |

*Primary Examiner*—Rinaldi I. Rada
*Assistant Examiner*—Boyer Ashley
*Attorney, Agent, or Firm*—Leydig, Voit & Mayer, Ltd.

[57] ABSTRACT

The leading end portion of an elongated length of wire is cut off from the remaining length of wire each time the wire dwells after being advanced along a generally horizontal path. The cutting is effected by moving a cutter downwardly into cutting engagement with the wire and by immediately thereafter moving a wiper downwardly into engagement with the leading end portion of wire to push that portion downwardly and, if necessary, to cause shearing of any uncut diameter of the wire. The cutter and the wiper are actuated by a single, double-acting eccentric which serves to positively advance and positively retract both the cutter and the wiper. The cutter is carried by an arm which is actuated directly by the eccentric while the wiper is carried by a pivoted link connected to the arm. The eccentric, the arm and the link coact to cause the wiper to overtake the cutter as the cutter approaches the bottom of its cutting stroke.

8 Claims, 4 Drawing Sheets

APPARATUS FOR CUTTING WIRE

BACKGROUND OF THE INVENTION

This invention relates generally to apparatus for cutting wire and, more particularly, to apparatus for cutting off successive leading end portions of an elongated length of wire adapted to be advanced along a predetermined path by feed rolls or the like. After a predetermined length of wire has advanced, a cutter is actuated and cuts into the wire to sever the leading end portion of the wire from the remaining length of wire. In high speed apparatus requiring a rapidly cycling cutter, the feed rolls are continuously rotated and slippage of the feed rolls enables the wire to dwell as the wire is cut. Upon completion of the cut, the next portion of wire immediately advances past the cutter. The cutter thus must be advanced and retracted very quickly.

In shearing the wire, the cutter knife may pass entirely through the wire or only partly through the wire. In both cases, shearing is complete although, when the device is set up so that the knife does not pass entirely through the material, the ends may "stick together". A wiper finger is provided to engage the wire very shortly after the cutter penetrates; the wiper acts to push the leading end portion of the wire out of the path of the remaining length of wire. After the wire has been severed, the cutter and the wiper are retracted to allow the next length of wire to advance into cutting position.

Typically, the cutter and the wiper are actuated by a continuously rotating motor shaft which acts through a one-revolution clutch. After the wire has been advanced to the cutting position, the clutch is automatically engaged, its output shaft is rotated through one revolution and the clutch then automatically disengages.

In prior wire cutting apparatus, the output shaft of the clutch rotates two cams. One cam acts against the cam follower of a swingable arm to actuate the cutter through its active stroke. The second cam coacts with the cam follower of a second swingable arm to move the wiper through its active stroke. Return springs act against the two arms to retract the cutter and the wiper after the wire has been cut. The return springs serve to maintain the cam followers in contact with the cams. In order to meet the requirement of fast cutter cycling, the force exerted by the return springs is quite large. The heavy return springs, while they are needed to rapidly move the knife out of the path of the advancing wire, create certain disadvantages. First of all, the high forces created by heavy return springs create wear on the bearings of the followers, and can cause early failure. Secondly, if the springs are not sufficiently heavy, the cam follower can lift from the cam, and the resulting "bumping" is not only harmful to the machine, but can cause the components to cycle out of phase, potentially causing a jam.

Wire cutting apparatus of the foregoing type is advantageous in that the use of two cams makes it relatively easy to establish a properly timed relationship between the action of the knife and the action of the wiper. Also, a full 180 degrees of cam rotation is available to actuate the cutter and thus a relatively fast cut may be effected. Such apparatus is disadvantageous, however, in that the cam follower of the swingable arm of the cutter is offset laterally from the cutter and, as a result, a twisting load is imposed on the cutter and on the pivot bearing of the arm when the cutter encounters the wire. The requirement for two cams, two followers, two swingable arms and two return springs to actuate the cutter and the wiper makes the apparatus relatively complex and expensive. In addition, the heavy return springs add load to the one-revolution clutch since the clutch drives against the force of the springs during the active strokes of the cutter and the wiper.

SUMMARY OF THE INVENTION

The general aim of the present invention is to provide high speed wire cutting apparatus of the above general type which is of simpler and less costly construction while being less resistant to the driving force and less susceptible to unbalanced loading and excessive wear.

A more detailed object of the invention is to achieve the foregoing by providing apparatus in which the cutter and the wiper are an integrated unit and are operated in properly phased relation by a single actuator and without need of return springs.

Still another object is to provide an extremely simple double acting eccentric for driving an integrated cutter and wiper in such a manner as to cause the wiper to be brought into engagement with the leading end portion of a length of wire immediately after the cutter has penetrated the wire, to cause the wiper to overtake the cutter and push the wire downwardly, and thereafter to retract the cutter and the wiper preparatory to the next cut.

The invention also resides in the provision of a link which coacts with the eccentric to control the path of the cutter and the wiper and to cause the wiper to overtake the cutter as the latter approaches the end of its cutting stroke.

These and other objects and advantages of the invention will become more apparent from the following detailed description when taken in conjunction with the accompanying drawings.

Figure 1:
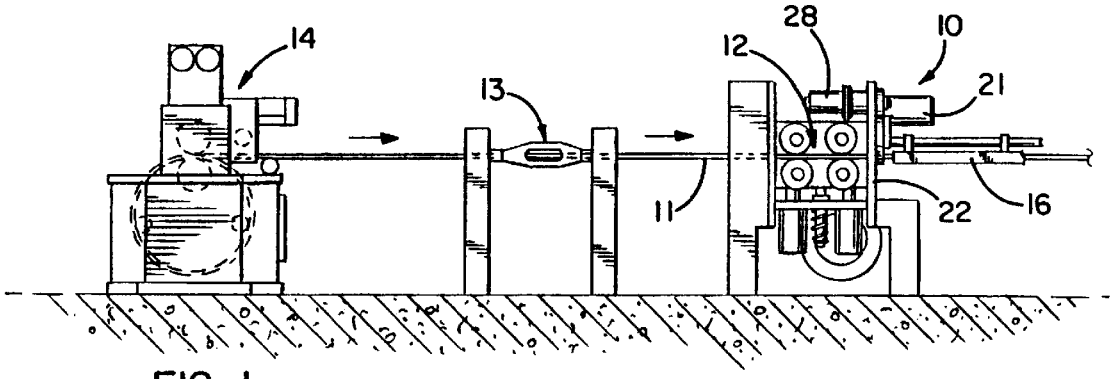
FIG. 1 is a front elevational view which schematically shows new and improved wire cutting apparatus of the present invention in a typical operating environment.

While the invention is susceptible of various modifications and alternative constructions, a certain illustrated embodiment thereof has been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

For purposes of illustration, the invention has been shown in the drawings as incorporated in apparatus 10 for cutting off successive leading end portions of an elongated length of wire 11 adapted to be fed along a predetermined path. While the cutting apparatus 10 may be used in many different applications, it herein has been shown in conjunction with a feed mechanism 12 which pulls wire through wire straightening apparatus 13 that, in turn, is supplied with wire from an unwinding station 14, or from a wire drawing machine.

Figure 2:
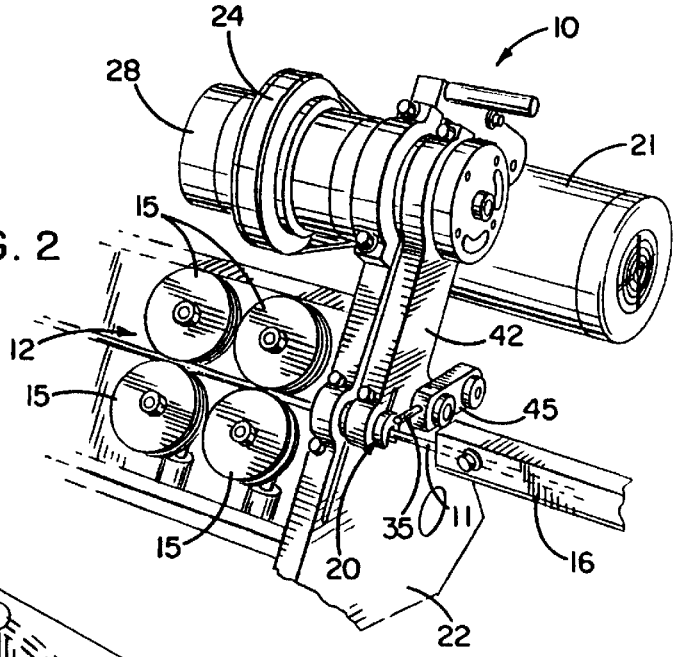
FIG. 2 is a perspective view of the wire cutting apparatus.

The feed mechanism 12, the straightening apparatus 13 and the wire supply 14 do not constitute part of the invention and need not be described in detail. It will suffice to say that the feed mechanism 12 includes two pairs of upper and lower feed rolls 15 (FIG. 2) which are rotated so as to pull the wire through the straightening dies 13 and to advance past the cutter toward an output station. Each time a wire length of suitable dimension is advanced past the cutter, the leading end portion of the wire is cut off from the remaining length of wire, the cutting taking place at a cutting station located just downstream of the feed mechanism. During the cutting operation, the leading end portion of the wire is supported in a conventional trough 16 located immediately downstream of the cutting station. After each cut, the bottom of the trough is automatically opened in a well known manner to enable the cut-off wire portion to drop downwardly out of the path of the following portion of wire.

Figure 3:
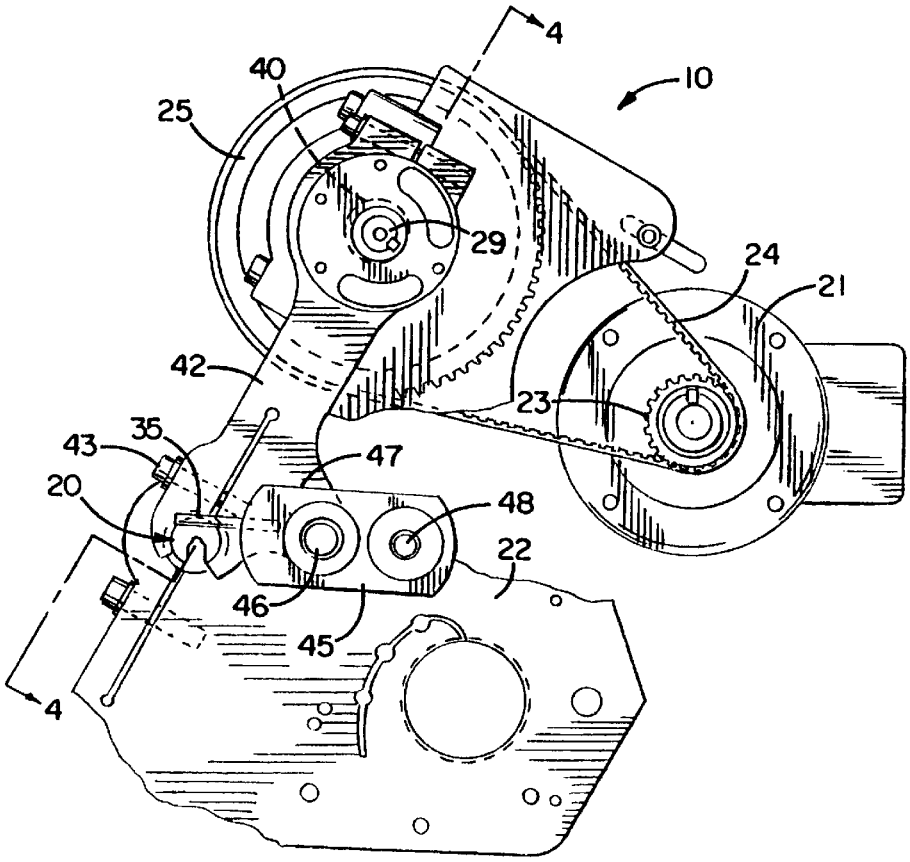
FIG. 3 is an enlarged end elevational view of the wire cutting apparatus shown in FIG. 2.
Figure 4:
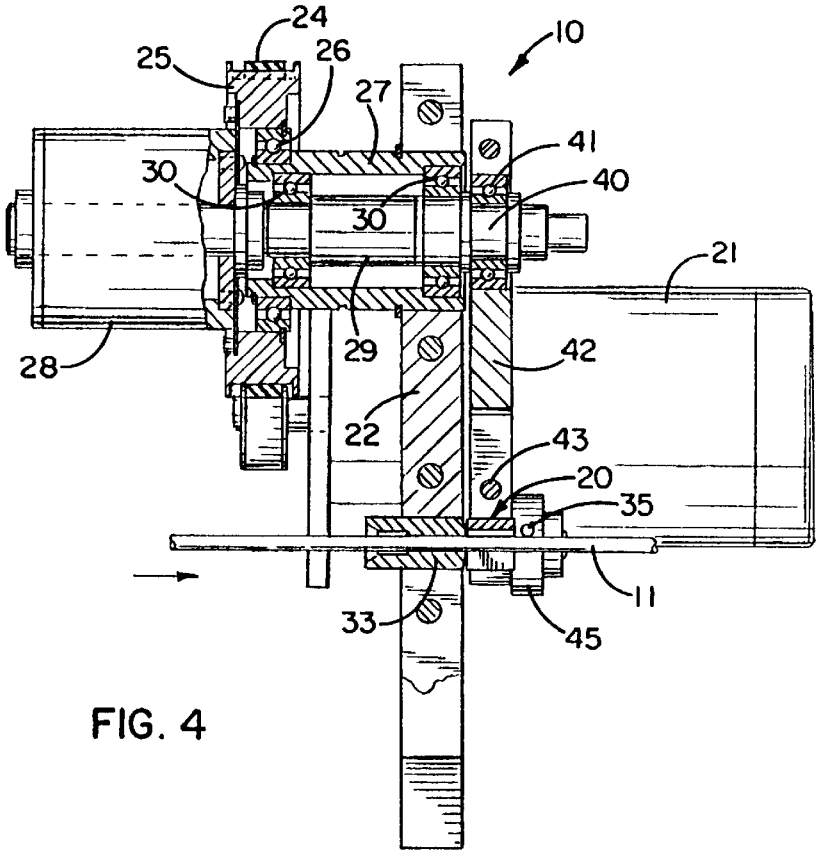
FIG. 4 is a fragmentary cross-section taken substantially along the line 4—4 of FIG. 3.

The cutting apparatus 10 includes a conventional cutter 20 which is adapted to be oscillated upwardly and downwardly by an electric motor 21 mounted on a main support in the form of a supporting bracket 22, the rotary output shaft of the motor carrying a sprocket 23 (FIG. 3). A toothed belt 24 is trained around the sprocket 23 and around a larger sprocket 25 which is journaled by a bearing 26 (FIG. 4) on a sleeve 27 attached to the supporting bracket 22. The sprocket 25 rotates the input of a one-revolution clutch 28 whose output acts to rotate a shaft 29 which is journaled in bearings 30 in the sleeve 27. The sprocket 25 is rotated continuously by the motor 21 but the clutch 28 is normally disengaged and thus the shaft 29 is normally idle. When the wire 11 advances to the desired and suitable length, the clutch is automatically engaged and acts to turn the shaft 29 through one revolution, at the end of which the clutch is automatically disengaged. The rotary motion of the shaft is used to oscillate the cutter 20 first downwardly and then upwardly so as to advance the cutter downwardly into cutting engagement with the wire and then to retract the cutter upwardly out of the path of the advancing length of wire. In the preferred embodiment the cutter must be advanced and retracted at a rapid rate.

Figure 6:
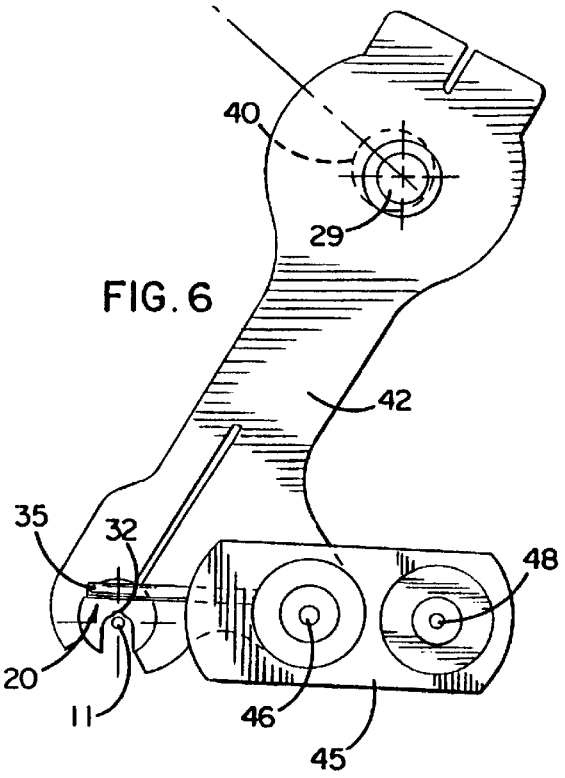
FIGS. 6 and 7 are somewhat schematic views which show successive positions of the cutter and the wiper.

As shown most clearly in FIG. 6, the cutter 20 herein is in the form of a block having a generally U-shaped throat whose upper end defines an arcuate cutting edge 32. When the cutter 20 is advanced through its cutting stroke, the cutting edge 32 engages the wire 11 at a location closely adjacent the bracket 22 and closely adjacent an arbor 33 (FIG. 4) mounted in the bracket and used to guide the wire into the cutting station. In some cases, the cutting edge passes completely through the wire and thus completely severs the leading end portion of the wire from the remaining length of wire. In other cases, usually with larger diameter wire, the knife is set so that the cutting edge penetrates only part way through the wire, although that part penetration serves to completely sever the wire. In that case, however, the material of the wire may remain "attached" even though the wire is technically severed.

To assure that the jaw of the knife is cleared immediately after severing the wire, so that the leading edge of the wire may advance into the output section, a wiper 35 moves downwardly into engagement with the wire shortly after the cutter engages the wire. If the material at the cut remains attached, the action of the wiper separates the material and moves the cut end out of the path of the advancing lead end. In both cases, the wiper pushes the cut-off portion of wire downwardly from the trough 16 in order to enable the next length of wire to quickly advance.

According to the present invention, the cutter 20 and the wiper 35 are both oscillated by a single actuator 40 which acts to positively move the cutter and wiper not only through their active strokes but also through their return strokes. As will become apparent, the use of the single and positively acting actuator significantly reduces the complexity and cost of the wire cutting apparatus 10, enables the clutch 28 to operate with relatively low loads, and reduces side loading of the cutting apparatus during the cutting operation.

Figure 5:
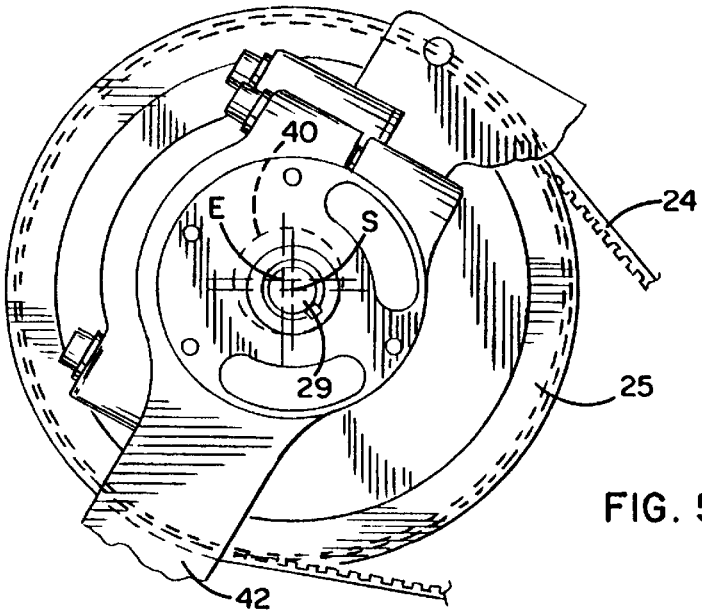
FIG. 5 is an enlarged view of certain parts shown in FIG. 3.

In the preferred form of the invention, the actuator 40 is an eccentric which is formed as an integral part of the shaft 29. The eccentric 40 is a circular member whose axis E (FIG. 5) herein is offset approximately 0.200" from the axis S of the shaft.

The eccentric 40 is journaled in a bearing 41 (FIG. 4) mounted in the upper end portion of a cutter holder which herein is in the form of an elongated arm 42. The cutter 20 is clamped in the lower end portion of the arm by a screw 43 (FIG. 3). By loosening the screw, the cutter 20 may be replaced with a cutter adapted to shear wire of different diameter.

In keeping with the invention, the wiper 35 is carried by a holder in the form of a link 45 which is adapted to be rocked by the eccentric 40 when the cutter 20 is actuated by the eccentric. Herein, the wiper is in the form of an elongated cylindrical rod made of cold rolled steel. One end portion of the wiper is anchored within a hole in the forward end portion of the link 45.

The opposite or free end portion of the wiper 35 projects forwardly from the forward end of the link 45 and is located adjacent the downstream side of the cutter 20. The link is positioned adjacent the downstream side of the arm 42 and its forward end portion is pivotally connected at 46 (FIG. 3) to a rearwardly projecting ear 47 formed integrally with the lower end portion of the arm. The rear end portion of the link is pivotally connected to the supporting bracket 22 as indicated at 48. Both pivots extend horizontally and parallel the axis E of the eccentric. In one specific embodiment where the eccentric has a throw of 0.200", the pivots are spaced approximately 2.1" from one another while the front pivot 46 is spaced rearwardly about 2.7" from the centerline of the arm 42 and is spaced downwardly about 7.4" from the axis E of the eccentric 40. In that embodiment, the arm 42 has an effective length of 9.0", the effective length being the distance between the axis E of the eccentric and the centerline of the cutter 20.

FIG. 6 shows the position of the various components when the clutch 28 is disengaged and wire 11 is being advanced into the cutting station. When the components are so positioned, the arm 42 is stationary, the cutting edge 32 of the cutter 20 is spaced above the wire, and the wiper 35 is spaced a substantial distance above the cutting edge.

Figure 7:
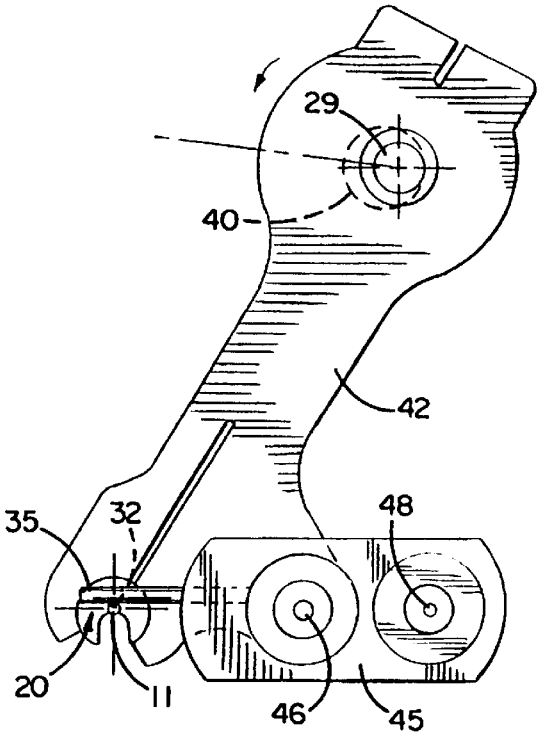
Figure 7A:
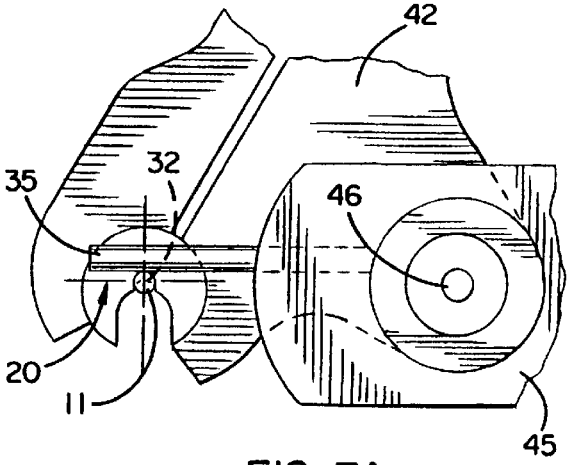
FIG. 7A is an enlarged view of certain parts shown in FIG. 7.

When the clutch 28 is engaged, the shaft 29 rotates the eccentric 40 counterclockwise from the position shown in FIG. 6 toward the position shown in FIG. 7. During such rotation, the eccentric acts through the arm 42 and causes the link 45 to rock counterclockwise about the rear pivot 48. At the same time, the arm rocks clockwise about the front pivot 46. As a result, the cutter 20 is moved downwardly toward the wire without undergoing any substantial change in attitude and, in addition, the wiper is rocked downwardly toward the cutting edge of the cutter to decrease the vertical spacing between the wiper and the cutter. When the components reach the position shown in FIGS. 7 and 7A, the cutter has traveled half way through its cutting stroke and its cutting edge 32 has penetrated the wire. The wiper is just starting to engage the wire.

Figure 8:
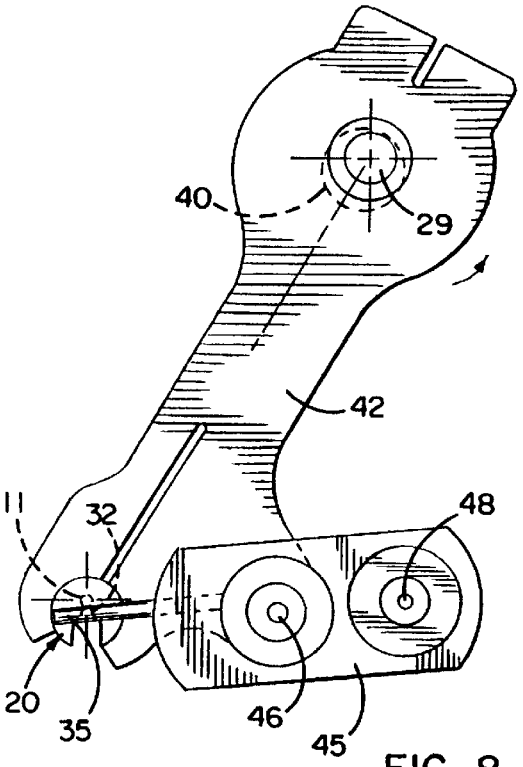
FIGS. 8 and 9 are somewhat schematic views which show additional successive positions of the cutter and the wiper.

With further rotation of the eccentric 40 from the position shown in FIG. 7 toward the position shown in FIG. 8, the link 45 is rocked further in a counterclockwise direction about the rear pivot 48 while the arm 42 rocks an additional increment in a clockwise direction about the front pivot 46. Thus, the cutter 20, while being maintained at a substantially constant attitude, is moved downwardly to the end of its cutting stroke, and the wiper 35 overtakes and moves downwardly past the cutting edge 32 of the cutter. With small diameter wire, the cutting edge may cut entirely through the wire and, as the cut is finished, the wiper acts to push the cut-off portion of wire downwardly. When the wire is of larger diameter, the cutter may reach the end of its cutting stroke without passing through the entire diameter of the wire. In such an instance, the wiper insures that the leading end portion of the wire separates from the remaining length of wire by virtue of the wiper moving downwardly beyond the cutting edge of the cutter.

Figure 9:
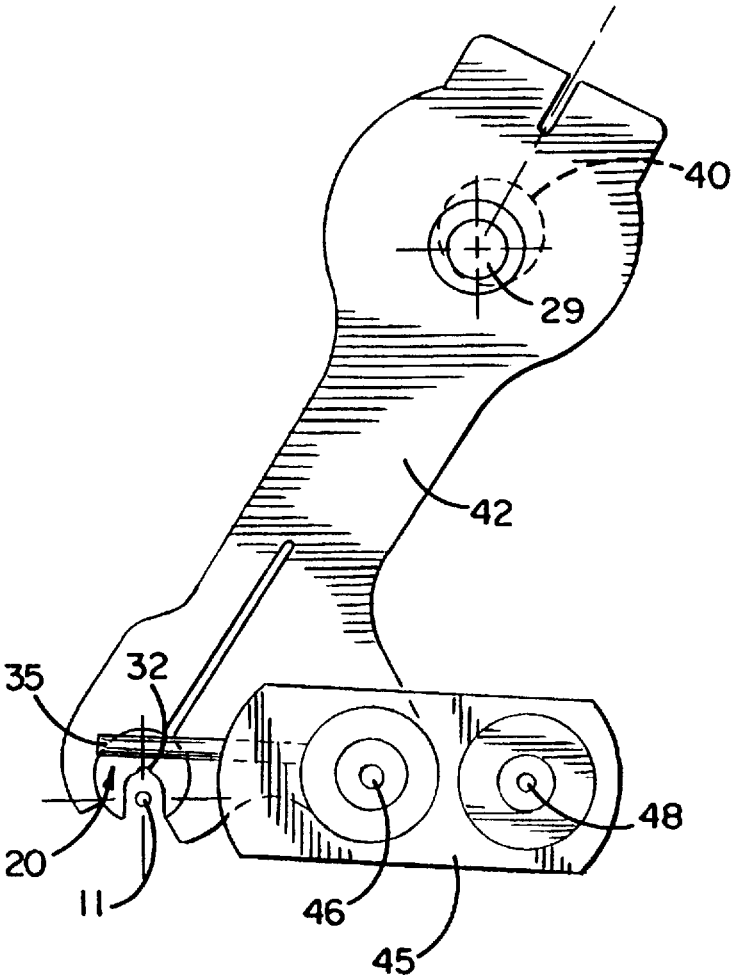

FIG. 8 shows the cutter 20 and the wiper 35 at the bottom of their active strokes and, as shown, the high point of the eccentric 40 lies on the centerline of the arm 42. With further counterclockwise rotation of the eccentric, the link 45 is rocked clockwise about the rear pivot 48 and, at the same time, the arm 42 rocks counterclockwise about the front pivot 46. This retracts the cutter and the wiper toward the position of FIG. 9, which shows the eccentric rotated 180 degrees from the position of FIG. 8 and which represents the highest location of the cutter and the wiper. The remainder of the counterclockwise revolution of the eccentric is used to return the components from the position of FIG. 9 to that of FIG. 6, whereupon the clutch 28 is disengaged and the components dwell until the next cutting cycle is initiated.

From the foregoing, it will be apparent that both the cutter 20 and the wiper 35 are positively actuated through their active and return strokes by the single eccentric 40 which acts directly on the cutter holder 42 and acts on the wiper holder 45 through the cutter holder. As a result of the single actuator 40, the cutting apparatus 10 is far less complex than prior apparatus in which a cutter and wiper are driven through active strokes by separate cams and are retracted by heavy return springs. Because the cutting apparatus 10 is free of return springs, there is no significant load on the clutch 28 during the active stroke of the cutter 20 other than the force created by the cutting action itself. The force imposed by the eccentric 40 on the holder or arm 42 is directly in line with the reaction force exerted on the arm during the cutting operation and thus no significant side loads are imposed on the arm, the eccentric or the cutter. Accordingly, the cutting apparatus 10 not only is of relatively simple construction but also is substantially trouble-free in operation and is capable of experiencing a comparatively long service life.

What is claimed is:

1. Apparatus for cutting wire, said apparatus comprising a support, a wiper holder having a wire wiper and mounted on said support to pivot about a first axis, a cutter holder having a wire cutter and connected to said wiper holder to pivot relative to said wiper holder about a second axis parallel to the first axis, and an actuator acting directly on one of said holders and acting on the other holder through said one holder to cause said wiper holder to pivot about said first axis and to simultaneously cause said cutter holder to pivot about said second axis.

2. Apparatus as defined in claim 1 in which said actuator comprises a power-rotated eccentric acting directly on said cutter holder and acting on said wiper holder through said cutter holder, said eccentric being rotatable about an axis paralleling said first and second axes.

3. Apparatus as defined in claim 1 in which said actuator causes said wiper holder to pivot about said first axis in a first direction and said cutter holder to pivot about said second axis in a second direction opposite the first direction.

4. Apparatus for cutting off successive leading end portions of an elongated length of wire adapted to be advanced along a predetermined path through a cutting station, said apparatus comprising a support located adjacent said cutting station, a wiper holder having a wire wiper and mounted on said support to pivot about a first axis, a cutter holder having a wire cutter and connected to said wiper holder to pivot relative to said wiper about a second axis, said cutter holder and said wiper holder operative between active and inactive positions with respect to said wire about said second and first axes respectively, and means acting directly on the cutter holder for moving the cutter holder between the active and inactive positions, said means for moving the cutter holder also acting through said cutter holder to move said wiper holder between the active and inactive positions in response to movement of said cutter holder.

5. Apparatus as defined in claim 4 in which said wiper trails said wire cutter during initial movement of said wiper and cutter holders toward said active positions and overtakes said wire cutter during final movement of said wiper and cutter holders toward said active positions.

6. Apparatus for cutting off successive leading end portions of an elongated length of wire adapted to be advanced along a predetermined path through a cutting station, said apparatus comprising a support located adjacent said cutting station, a wiper holder having a wire wiper and mounted on said support to pivot about a first axis, a cutter holder having a wire cutter at a cutter end of the cutter holder, means for moving said cutter holder back and forth on said support between an active position, in which the wire cutter obstructs at least a portion of the path, and an inactive position, in which the wire cutter is completely outside of the path, said means for moving said cutter holder comprising a power-rotated eccentric, the cutter holder operatively connected to the wiper holder and directly journaled on the eccentric so that the rotating eccentric positively pivots said wiper holder back and forth about the first axis and said cutter holder back and forth about the second axis parallel to the first axis thereby to move said cutter holder between said active and inactive positions.

7. Apparatus as defined in claim 6 in which said eccentric comprises a circular member having a central axis extending parallel to said first and second axes, said cutter holder being journaled on said member to turn relative to said circular member about said central axis, and means mounting said circular member on said support to rotate relative to said support about an axis offset from said central axis.

8. Apparatus as defined in claim 6 further including said wiper holder mounted on a link to rock with said link about said first axis, said eccentric moving said cutter holder and said link such that said wire wiper is spaced from said wire as said wire cutter first cuts into said wire and then engages said wire and moves past said cutter before said cutter holder is retracted toward said inactive position.

* * * * *